United States Patent [19]

Carlson

[11] Patent Number: 4,674,888

[45] Date of Patent: Jun. 23, 1987

[54] GASEOUS INJECTOR FOR MIXING APPARATUS

[75] Inventor: Richard F. Carlson, Palos Verdes Estates, Calif.

[73] Assignee: Komax Systems, Inc., Long Beach, Calif.

[21] Appl. No.: 801,675

[22] Filed: Nov. 25, 1985

Related U.S. Application Data

[63] Continuation of Ser. No. 617,675, May 6, 1984, abandoned.

[51] Int. Cl.[4] ..... B01F 3/04

[52] U.S. Cl. ..... 366/337; 162/65; 162/66; 261/76; 261/94; 261/124; 366/101; 366/338

[58] Field of Search ..... 261/76, 77, 78 A, 93, 261/123, 124, DIG. 75, 94–98; 366/101, 103, 107, 322, 339, 340, 338; 209/170; 162/63, 65, 66; 210/221.2; 422/224, 231

[56] References Cited

U.S. PATENT DOCUMENTS

| | | | |
|---|---|---|---|
| 2,585,205 | 2/1952 | Young | 261/76 |
| 3,489,396 | 1/1970 | D'Aragon | 261/76 X |
| 3,953,002 | 4/1976 | England, Jr. et al. | 366/322 |
| 4,068,830 | 1/1978 | Gray | 366/340 X |
| 4,215,082 | 7/1980 | Danel | 261/124 |
| 4,370,304 | 1/1983 | Hendriks et al. | 261/DIG. 75 |

FOREIGN PATENT DOCUMENTS

| | | | |
|---|---|---|---|
| 694918 | 7/1953 | United Kingdom | 261/DIG. 75 |

*Primary Examiner*—Richard L. Chiesa
*Attorney, Agent, or Firm*—Malcolm B. Wittenberg

[57] ABSTRACT

A gas injector element for use in a mixing apparatus having a plurality of mixing elements, where the injector element is airfoil-shaped and is installed adjacent to the first of the plurality of mixing elements. The airfoil-shaped injector is fabricated from a metal or other suitable material having a porosity within a range of 0.5 to 100 or more microns, such that fluid injected into the mixing conduit through the injector will be released from the injector and will immediately contact material flowing through the conduit without the undesirable result of bubbles of the fluid or gas flowing from the injector coalescing with larger bubbles resulting in ineffective mixing of the gas with the material in the mixer.

1 Claim, 5 Drawing Figures

GASEOUS INJECTOR FOR MIXING APPARATUS

DESCRIPTION

This is a continuation of application Ser. No. 617,675 which is now abandoned.

1. Technical Field

This invention relates to a new and improved gaseous injector of the type to be used with a material mixing apparatus (either stationary or movable) for injecting gas or other fluids into the mixer's processing stream such that the gases will make immediate contact with the mixer's contents without having the gas degraded or otherwise weakened before making sufficient contact with the mixer's contents.

2. Background Art

It is common practice to introduce gases or other fluids into the process stream of a mixing apparatus, such as a stationary or static mixer, in order to mix the gas or other fluids with the materials in the mixing apparatus which are being moved along any process stream by a liquid. A typical example where this practice is used is to inject a chlorine gas ($Cl_2$) or oxygen ($O_2$) into a mixture of pulp stock where the chlorine gas or oxygen is used to bleach the stock which is eventually used to make paper.

In order to achieve good blending or mixing between the mixer's contents (for example, pulp stock) and the gas (for example, chlorine or oxygen), it is desirable for the gas to form many tiny or microscopic bubbles so as to achieve a large surface area for effectively blending the gas with the mixer's contents when the gas bubbles attach themselves to the mixer's contents such as pulp fiber to start the bleaching process. In the gaseous injector elements of the prior art, a gas which is injected into the process stream usually expands to form large bubbles which coalesce, i.e., grow together or unite as a whole, before sufficiently blending with the mixer's contents. The prior art injector elements have large discharge slots or holes which (because of their size) discharge large gaseous bubbles which coalesce to form even larger bubbles. This results in a reduction in the contacting or mixing efficiency of the gas with the liquid or material in the mixing apparatus. Further, when these large bubbles are created, they will rise in the mixer and will cause smaller or even microscopic bubbles in some instances to coalesce to form large bubbles, thus resulting in excess use of oxygen and lower stock brightness. This undesirable result occurs when there is a lag between the time that the gas enters the process stream of the mixer and the time in which it makes contact with the mixer's contents.

DISCLOSURE OF INVENTION

In view of the problems outlined above which occur when a gas, injected into a mixing apparatus, is not sufficiently blended with the mixer's contents, it is desirable that there be some means for injecting a gas or other fluid into a mixer such that the gas injected will immediately and effectively blend with the mixer's contents prior to being degraded by other elements in the process stream. Accordingly, I had invented a gas injector to be used in connection with a mixing element in a mixing apparatus, where the injector is airfoil-shaped and is designed such that when a gas is injected from the injector into the mixing process, a uniform flow of microscopic size gaseous bubbles are produced across the diameter of the mixing conduit. More particularly, I have invented an airfoil-shaped injector which may be installed adjacent to the leading edge of the first of a plurality of mixing elements and which is fabricated from porous material such that when a gas is injected into the process stream through the controlled porosity of the injector, the gas will immediately be disbursed through all the areas of the mixing element to make immediate contact with the liquids or other materials being carried through the mixer's process stream. The injector element may be either permanently bonded to one of several mixing elements or it may be removable.

BRIEF DESCRIPTION OF THE DRAWINGS

The advantages and characteristic features of the subject invention will be, in part, apparent from the accompanying drawings and, in part, pointed out in the following detail description of the best modes for carrying out the invention in which reference will be made to the accompanying drawings wherein like reference numerals designate corresponding parts and wherein.

BEST MODE FOR CARRYING OUT THE INVENTION

Figure 1:
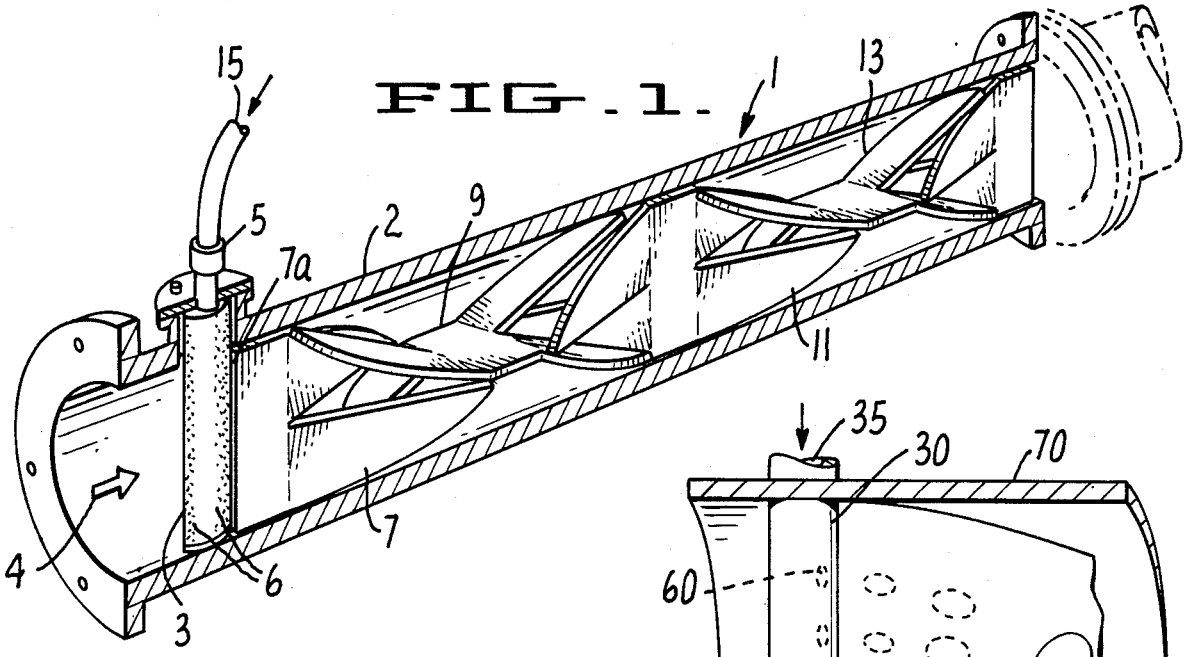
FIG. 1 is a partially schematic illustration of the gas injector element of the present invention shown installed adjacent the first element in a stationary mixing conduit.
Figure 3:
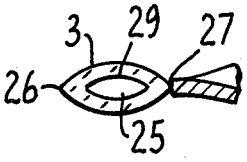
FIG. 3 is an end view of the airfoil-shaped injector element of the present invention being drawn along line 3—3 of FIG. 2.
Figure 2:
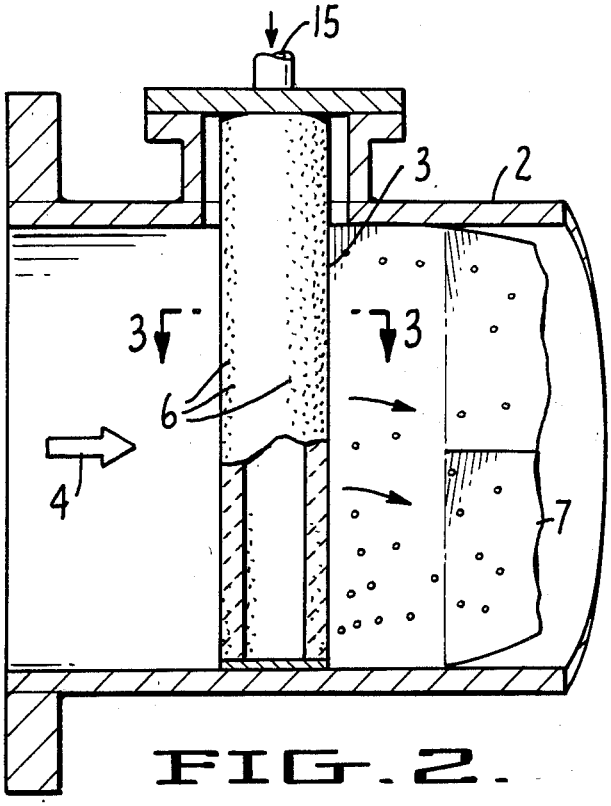
FIG. 2 is a side elevational view of the injector element of the present invention, illustrating a cutaway view of that element.

The present invention is best understood when FIGS. 1 through 3 are examined together. A cutaway portion of a stationary mixing apparatus, generally shown at reference 1 (FIG. 1), illustrates a plurality of mixing elements 7, 9, 11 and 13 which are positioned in a longitudinally extending conduit tube 2. The first one of the mixing elements disposed within conduit 2 has attached to its leading edge *7a* an injector element 3. Element 3 has an injector port 15 for receiving gas or other fluid to be disbursed within conduit 2 through micropores 6 to be mixed with the mixture flowing within conduit 2.

Element 3 has an airfoil-shape with a camber line 25 (FIGS. 1 and 3) extending from the leading edge of element 3 to the trailing edge 27 of element 3 (FIG. 3). Camber line 25 is ideally designed to be approximately three (3) times the length of the axis 29 drawn perpendicular to camber line 25. Element 3 further has a porosity within a range of 0.5 to 100 or more microns and may be manufactured of a durable material such as No. 316 stainless steel or a thermoplastic material depending on the application.

Because of the desired porosity of element 3 and the airfoil configuration of the element, material flowing past element 3 through conduit 2 as the material is being mixed with the gas being injected into conduit 2 through element 3, will not plug up or clog the pores 6 of element 3. This is perhaps the most significant improvement of my invention over the prior art designs and this feature will be more particularly pointed out when the prior art designs are subsequently discussed.

For example, when the apparatus of my invention is used for bleaching paper pulp stock, the stock is introduced to conduit 1 and flows through conduit 1 in the direction of arrow 4 where the pulp stock will be mixed with an additive (to be supplied through element 3) by means of the plurality of mixing elements 7, 9, 11 and 13, etc. The material such as pulp stock is moved through the process stream of conduit 2 in a whirling flow path in the direction of arrow 4 and a gas such as chlorine, oxygen or other fluid is being injected into the process stream through element 3. The injected gas is constantly being sprayed out through pores 6 which are located along element 3 on both sides of element 3. In this process, various fine microscopic oxygen bubbles are created and they are instantly and thoroughly being blended into the pulp stock. These small gas bubbles will then attach themselves to the pulp stock (or other material) and will immediately begin the bleaching process. It is desirable that the small bubbles do not coalesce with large gaseous bubbles since the result of such coalescence will be an ineffective mixing and bleaching of the materials, since when large bubbles are created they will rise to the top of conduit 2 causing the smaller or microscopic bubbles to coalesce with the large bubbles, thus resulting in an excess use of oxygen and a lower grade of bleaching of the pulp or other material.

With the apparatus of the invention only small microscopic gaseous bubbles are produced and they are immediately blended with the material moving through conduit 2. This eliminates the possibility of these microscopic bubbles coalescing with larger bubbles in conduit 2 to result in a less than desirable grade of bleaching.

Figure 4:
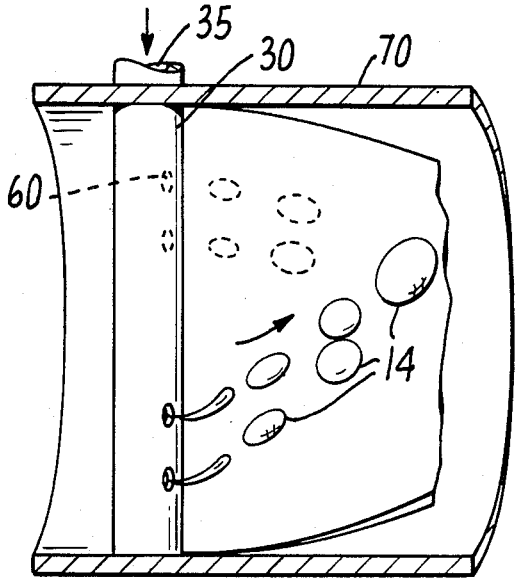
PRIOR ART FIG. 4.
FIG. 4 is a partially schematic view illustrating a prior art gaseous injector element.
Figure 5:
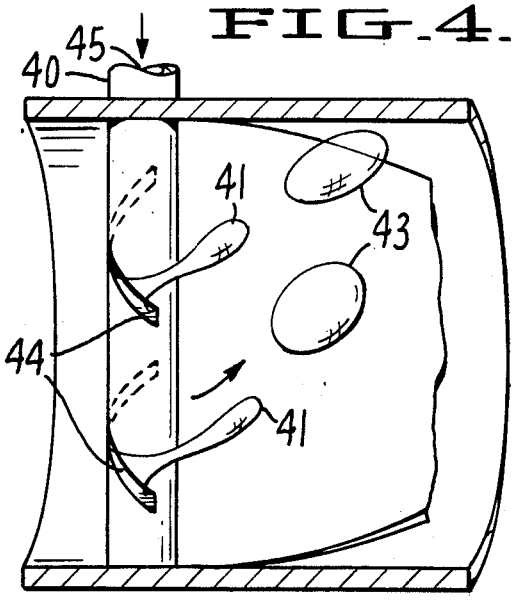
PRIOR ART FIG. 5.
FIG. 5 is another partially schematic view of another prior art gaseous injector element for use in a stationary mixing apparatus.

With the prior apparatuses such as those illustrated in FIGS. 4 and 5, gases being injected into mixing conduits 70 and 75 through holes 60 and 41 of gas injectors 30 and 40, respectively, usually require a great deal of power (100 hp to 150 hp) to create the necessary high shear to produce fine bubbles to be mixed with the material flowing through the conduit 2. Even when the prior art injectors, such as those in FIGS. 4 and 5, all of which have a rounded cylindrical shape, are designed with microscopic pores through which the gas flows into the conduit, the result is still that the pores of the injector will soon become clogged with the materials flowing through the conduit and the microscopic gas bubbles flowing through the microscopic pores will coalesce with larger bubbles of gas which have formed within the conduit. Thus, the results of such injectors and mixers incorporating them have been an ineffective mixing of the gas and the material such as pulp stock which results in ineffective bleaching of the material. All of these prior art problems have been solved with my invention.

It should be pointed out that the injector element of my invention can be incorporated in any mixing apparatus (stationary or active), regardless of the configuration of the mixing element(s). It is recommended that the injector is most efficient when it is installed adjacent to the first of a plurality of mixing elements within a mixing conduit, however, my invention is not intended to be so limited.

My invention has been described in detail with particular reference to certain embodiments thereof, but it will be understood that variations and modifications can be effected within the spirit and scope of my invention. My invention is intended to be limited only by the appended claims.

What is claimed is:

1. A mixing apparatus for mixing a fluid process stream and for injecting a second fluid therein comprising:

a tube with a longitudinally extending axis; an injector element positioned in said tube for injecting said second fluid within said fluid process stream;

a plurality of mixing elements positioned in said tube immediately downstream of said injector element and along said longitudinally extending axis for mixing said process stream, each of said mixing elements being configured such that the overall mixing stream of said apparatus comprises a plurality of left and right-hand mixing baffles and is mixed with the fluid being injected into the mixing stream from said injector element; and said injector element having an airfoil-shape wherein the camber line of the injector, extending from its leading edge to its trailing edge, is approximately three times the length of its axis extending perpendicular to the camber line, wherein said airfoil-shaped injector element is further characterized as possessing a plurality of microscopic pores along its longitudinal surface, said pores being of a size within a selected range between 0.5 to 100 microns such that pores remain substantially free of clogging while in contact with said fluid process stream.

* * * * *